US008534946B2

(12) United States Patent
Cont

(10) Patent No.: US 8,534,946 B2
(45) Date of Patent: Sep. 17, 2013

(54) CONTAINER FOR PROPELLING COSMETIC PENCILS, PROCESS FOR ASSEMBLING SUCH CONTAINER AND PROPELLING COSMETIC PENCIL

(75) Inventor: Franco Cont, Lugano (CH)

(73) Assignee: F.I.L.A. Fabrica Italiana Lapis Ed Affini S.p.A., Milan (IT)

( * ) Notice: Subject to any disclaimer, the term of this patent is extended or adjusted under 35 U.S.C. 154(b) by 688 days.

(21) Appl. No.: 12/766,989

(22) Filed: Apr. 26, 2010

(65) Prior Publication Data

US 2011/0262206 A1 Oct. 27, 2011

(51) Int. Cl.
*A45D 40/04* (2006.01)

(52) U.S. Cl.
USPC ..... 401/78; 401/68; 401/75; 401/87; 401/86

(58) Field of Classification Search
USPC ..... 401/68, 75, 78, 87, 86
See application file for complete search history.

(56) References Cited

U.S. PATENT DOCUMENTS

| | | | | |
|---|---|---|---|---|
| 5,294,205 | A * | 3/1994 | Moeck et al. | 401/70 |
| 5,423,623 | A * | 6/1995 | Bakic | 401/70 |
| 5,547,300 | A * | 8/1996 | Powers | 401/68 |
| 5,954,441 | A * | 9/1999 | Welschoff | 401/75 |
| 6,071,027 | A * | 6/2000 | Gueret | 401/75 |
| 6,200,047 | B1 * | 3/2001 | Holloway | 401/75 |
| 6,866,438 | B2 | 3/2005 | Bauer et al. | |
| 6,905,272 | B2 * | 6/2005 | Yamanaka | 401/75 |
| 2003/0129014 | A1 | 7/2003 | Bauer et al. | |
| 2004/0020811 | A1 | 2/2004 | Yamanaka | |

FOREIGN PATENT DOCUMENTS

| | | | |
|---|---|---|---|
| DE | 20017141 | U1 | 12/2000 |
| GB | 516189 | A | 12/1939 |
| JP | 2006158781 | A | 6/2006 |

* cited by examiner

*Primary Examiner* — David Walczak
*Assistant Examiner* — Bradley Oliver
(74) *Attorney, Agent, or Firm* — Pearne & Gordon LLP

(57) ABSTRACT

A container for propelling cosmetic pencils includes a holding body (4), a lead-holder (7) axially movable in the holding body (4) and having a seat (9) facing a first opening (4*a*) of the holding body (4) and designed to receive a lead (3) of cosmetic material, a driving element (13) movable in rotation in the holding body (4) and having an operating portion (14) protruding from a second opening (4*b*) of the holding body (4), a threaded body (12) being part of the lead-holder (7) or the driving element (13), for converting the rotation motion of the operating portion (14) into an axial motion of the lead-holder (7), and radially flexible tabs (16) integral with the driving element (13) or the lead-holder (7) and having threaded portions (17) in engagement with the threaded body (12).

12 Claims, 5 Drawing Sheets

FIG 3b
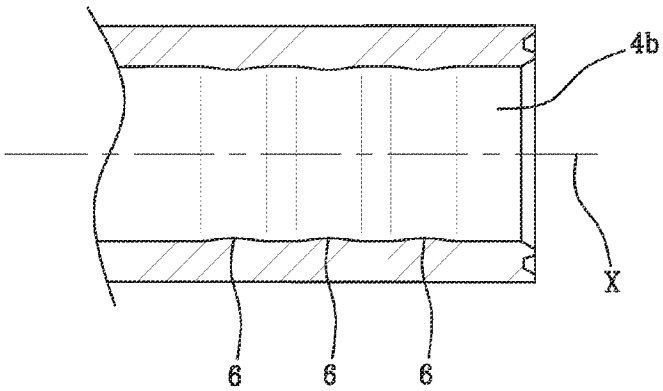
FIG 3a
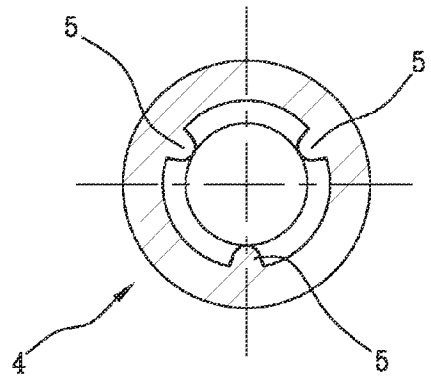
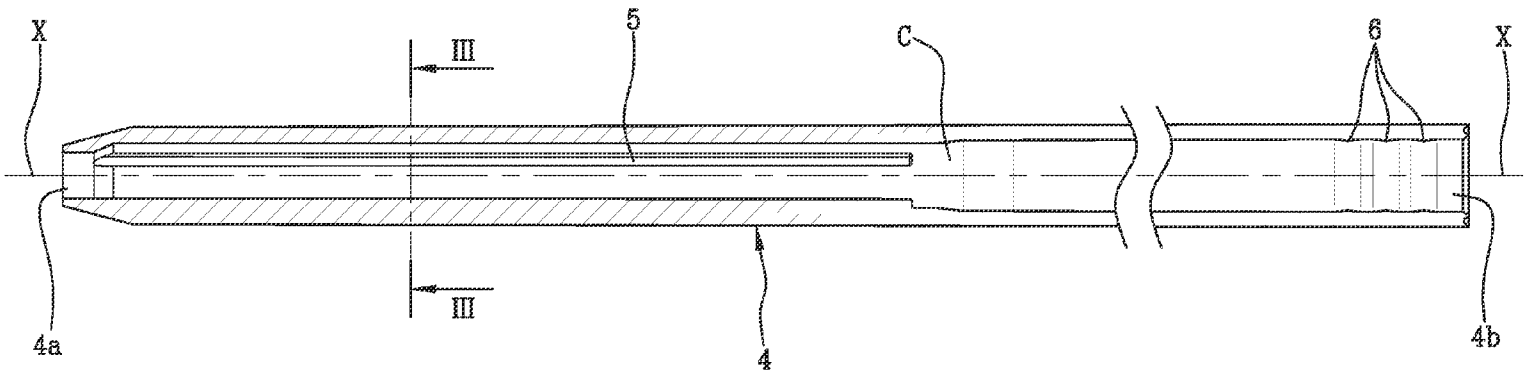
FIG 3

CONTAINER FOR PROPELLING COSMETIC PENCILS, PROCESS FOR ASSEMBLING SUCH CONTAINER AND PROPELLING COSMETIC PENCIL

FIELD OF THE INVENTION

The present invention relates to a container for propelling cosmetic pencils, to a process for assembling such a container and to a propelling cosmetic pencil comprising such a container.

DESCRIPTION OF RELATED ART

The propelling cosmetic pencils are used for applying a cosmetic substance onto the body, usually the face, for instance for the purpose of highlighting the eye contour, eyebrows, lip contour, and so on.

Cosmetic pencils are known which comprise an outer body made of wood or plastic material and a core (the lead) consisting of a decorative cosmetic substance rigidly and fixedly introduced into the body and substantially extending over the whole length of the body. As the lead tip is being used, it is necessary to sharpen the pencil in order to remove part of the wood or plastic material and to uncover a new lead portion. Pencils of the described type become increasingly shorter with use until they reach such a length that their use becomes so difficult that they often are thrown away without any possibility of fully utilising them. In addition, the lead is only protected by a cap that is removed and put back. During both operations, a casual interference between cap and lead tip can damage said tip and/or soil the cap.

Also known are propelling pencils like the one disclosed in document GB 516,189. The pencil of this document comprises an outer casing provided at one end thereof with a tapering nozzle through which the lead of cosmetic material is drawn out. The lead is retained by a lead-holder which is prevented from rotating at the inside of the outer casing. The lead-holder can be moved to and fro in the outer casing by a threaded rod connected to a rotary head placed on one end of the casing opposite to the tapering nozzle. The threaded rod is fitted in a threaded housing of the lead-holder that is at the opposite end of the lead. The pulling-out device enables the lead tip to be drawn out of the outer casing only when the pencil is being used.

The Applicant has found that the production cost of the propelling pencils of the type described above is greatly affected by the manufacture complexity of the individual elements (usually obtained by moulding of plastic materials) and the complexity of the operations for assembling said elements. In fact, for the assembly of each piece, a lot of time is required as well as use of expensive machines and/or qualified manpower.

The present invention aims at eliminating the above mentioned drawbacks, by providing a container for propelling cosmetic pencils that is of simple structure and allows easy and quick assembly of the elements forming it.

It is a further aim of the invention to propose a process for assembling this container which enables use of simple and inexpensive machines and/or non-specialised manpower.

Another aim of the invention is to propose a propelling cosmetic pencil ensuring correct conservation of the lead until complete use of same.

SUMMARY OF THE INVENTION

The foregoing and still further aims are achieved by a container for propelling cosmetic pencils, a process for assembling a container for propelling cosmetic pencils and a propelling pencil in accordance with the present invention.

More particularly, in a first aspect the present invention relates to a container for propelling cosmetic pencils as claimed in claim 1.

In a second aspect, the present invention relates to a process for assembling a container for propelling cosmetic pencils according to claim 12.

In a third aspect, the present invention relates to a propelling cosmetic pencil as claimed in claim 11.

The present invention, in at least one of the aforesaid aspects, can in addition have one or more of the preferred features claimed in the dependent claims.

BRIEF DESCRIPTION OF THE DRAWINGS

The present invention will be now described with reference to the accompanying drawings illustrating a preferred but not exclusive embodiment of a propelling cosmetic pencil, in which:

FIG. 3 shows a longitudinal section of a first element of the pencil seen in FIGS. 1 and 2;

FIG. 3*a* is a cross-section view of the first element, taken along line in FIG. 3;

FIG. 3*b* shows a portion of FIG. 3 to an enlarged scale;

DETAILED DESCRIPTION OF PREFERRED EMBODIMENTS OF THE INVENTION

Figure 1:
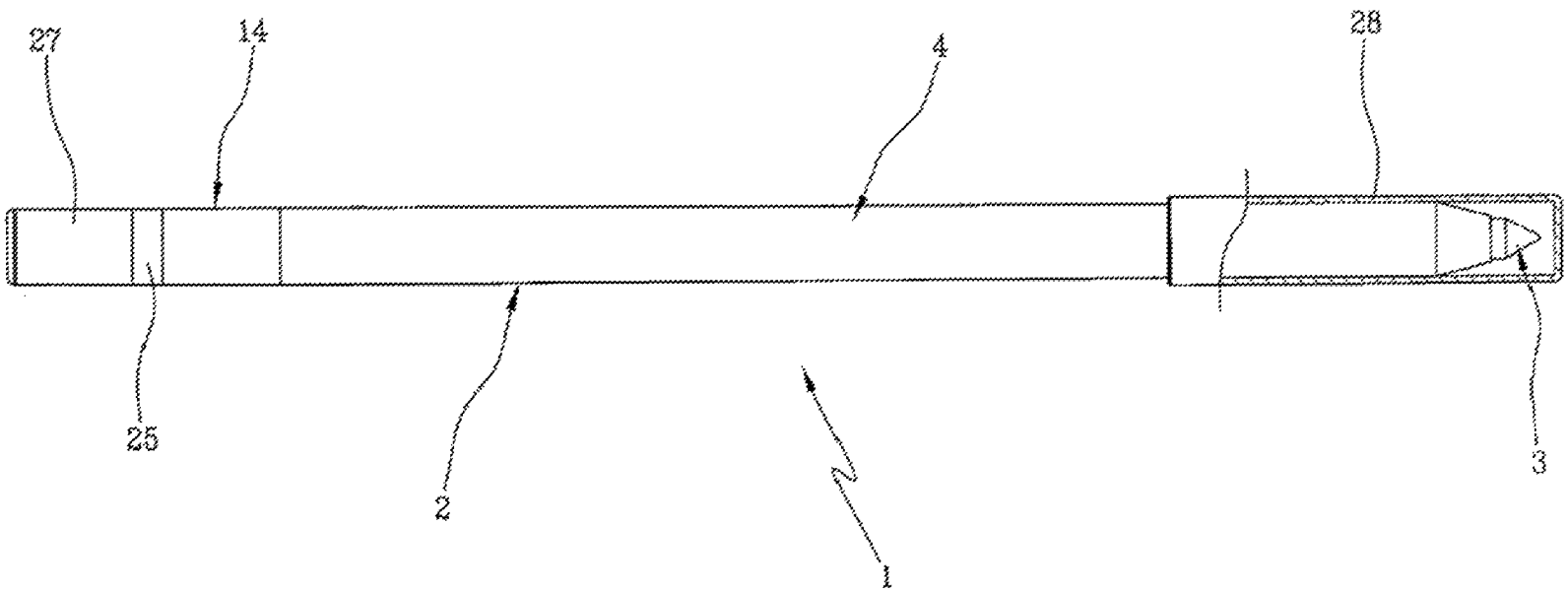
FIG. 1 is a partly sectioned view of a propelling cosmetic pencil according to the present invention.

With reference to the accompanying drawings, a propelling cosmetic pencil according to the present invention has been generally identified by reference numeral 1.

The cosmetic pencil 1 comprises a container 2 and a lead 3 mounted in the container 2 in an axially movable way.

In the present specification and in the claims, by "lead" it is intended a cylindrical bar of cosmetic material.

Container 2, shown in an assembled condition in FIG. 1, comprises a holding body 4 of a tubular shape and circular section, which extends along a longitudinal axis X-X and has a first opening 4*a* placed at a first, preferably tapering, axial end and a second opening 4*b* placed at a second axial end opposite to the first one 4*a*.

On an inner surface of the holding body 4 there are ribs 5 extending parallel to the longitudinal axis X-X and preferably disposed angularly spaced apart around said axis X-X (as shown in FIG. 3*a*). In the embodiment given by way of example and not for limiting purposes, the axial ribs 5 are three in number. Radially internal ends of the axial ribs 5 are tangent to a circle substantially having the same diameter as that of lead 3. The axial ribs 5 extend as far as the first opening 4*a*, preferably starting from an intermediate portion of the holding body 4 (FIG. 3).

First annular ridges 6 delimiting annular recesses (FIG. 3*b*) are shaped on the inner surface of the holding body 4 and in the region close to the second opening 4*b*. In the embodiment given by way of non-limiting example there are three first annular ridges 6.

The inner surface of the holding body 4 has a conical shape getting narrower from the second end 4*b* to the first one 4*a*, for performing a function that will be described below.

This conical shape is preferably restricted to the only portion extending from the second end 4*b* to the beginning of ribs 5. More preferably, this conical shape is restricted to the only portion C located not very far from ribs 5 (FIG. 3).

Figure 4:
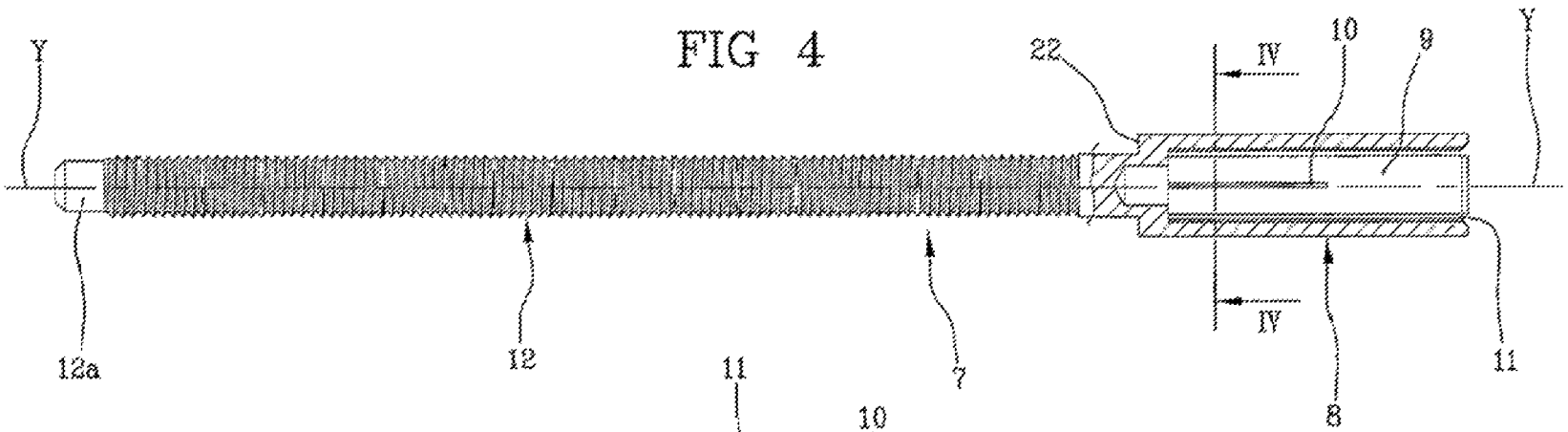
FIG. 4 shows a second element of the pencil seen in FIGS. 1 and 2, partly in section.
Figure 4A:
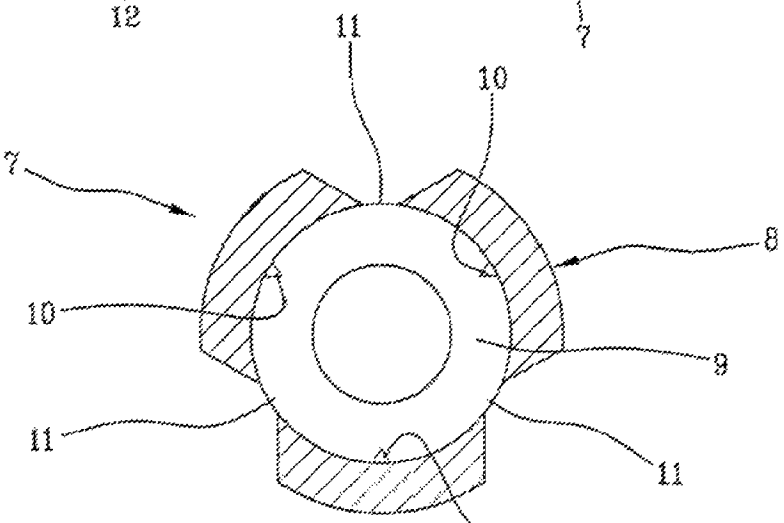
FIG. 4*a* is a cross-section view of the second element, taken along line IV-IV in FIG. 4.

Container 2 comprises a lead-holder 7 (FIGS. 4 and 4*a*) which in turn comprises a cylindrical wall 8 delimiting a seat 9 for lead 3. Formed on a radially internal surface of the cylindrical wall 8 are axial ridges 10 adapted to interfere with the soft material of lead 3 so as to keep the latter in place once it has been axially inserted in said seat 9 (no translation and no rotation relative to the lead-holder 7). Preferably, the axial ridges extend from a blind bottom of seat 9 until about halfway along wall 8. In the non-limiting embodiment shown, the cylindrical wall 8 is formed with three arched walls disposed in mutual side by side relationship. The side-by-side walls delimit three grooves or axial cuts 11 between each other. The lead-holder 7 further comprises a threaded body 12. Preferably, the threaded body 12 is in the shape of a rod provided with an outer threading extending along an axis Y-Y coincident with the longitudinal axis X-X, once the lead-holder 7 has been mounted in the holding body 4. Said axis Y-Y is also coincident with the longitudinal axis of the cylindrical body 8. The threaded body 12 extends starting from a portion of the lead-holder 7 that is close to the blind bottom of seat 9.

Figure 5:
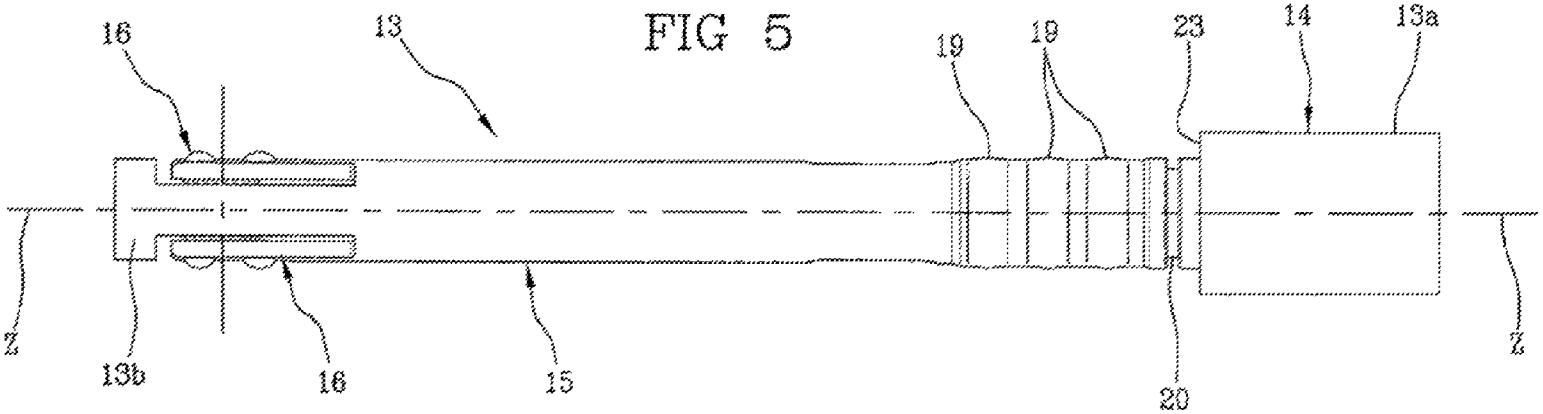
FIG. 5 shows a third element of the pencil seen in FIGS. 1 and 2.

Container 2 also comprises a driving element 13 (FIGS. 5, 5*a* and 5*b*) preferably of a tubular type, extending along a longitudinal axis Z-Z. The driving element 13 at a first end thereof 13*a* comprises a first portion or operating portion 14 having an outer diameter that is substantially identical with the outer diameter of the holding body 4. The driving element 13 comprises a second portion 15 having an outer diameter adapted to enable the same to be inserted into the holding body 4 and an inner diameter capable of enabling the threaded body 12 to be inserted in said second portion 15. Formed at a second end 13*b* of the driving element 13, in the wall of the second portion 15, are tabs 16 that are flexible, preferably in an elastic manner, along radial directions. Each tab 16 is delimited by a U-shaped notch (partly shown in FIG. 2) formed through the wall of the second portion 15 and extends parallel to the longitudinal axis Z-Z starting from a junction region with the remaining part of said wall towards the second end 13*b* of the driving element 13. In the embodiment shown, the driving element 13 comprises two opposite tabs 16. Each tab 16, on a radially internal surface thereof, has threaded portions 17 (FIG. 5*a*) suitable for engagement with the thread of the threaded body 12 belonging to the lead-holder 7.

Figure 5B:
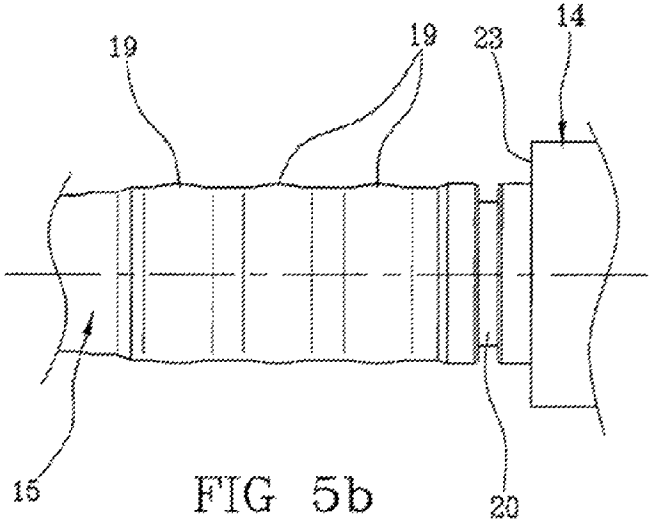
FIG. 5*b* shows a further enlarged portion of FIG. 5.
Figure 5A:
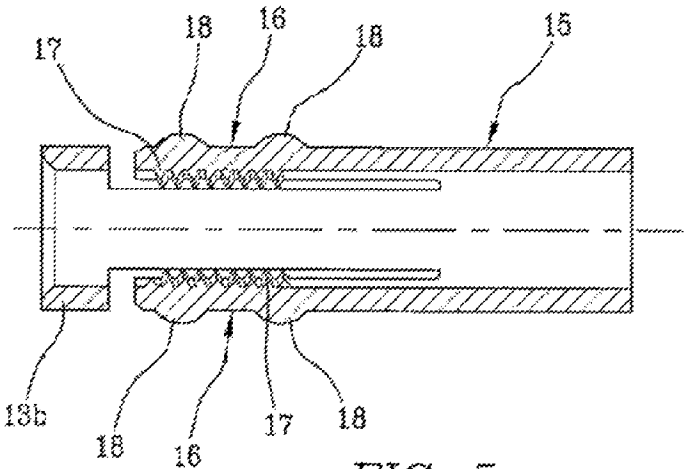
FIG. 5*a* is an enlarged portion in longitudinal section of the third element seen in FIG. 5.

Preferably, each tab 16 is further provided, on a radially external surface thereof, with protrusions 18 (FIG. 5*a*) interacting with the inner wall of the holding body 4. On an outer wall of the second portion 15 and close to the first portion 14 there are second annular ridges 19 confining annular recesses (FIG. 5*b*). In the non-limiting embodiment shown, there are three second annular ridges 19. Preferably, in addition, an annular seat 20 is formed between the second annular ridges 19 and the first portion 14, for housing a seal 21 (shown in FIG. 2).

Mounting of container 2 is carried out by first inserting a free end 12*a* of the threaded body 12 into the second end 13*b* of the driving element 13 and making said threaded body 12 axially slide within the second portion 15 until bringing the edge of the second end 13*b* in abutment against an annular surface 22 (FIGS. 2 and 4) transverse to axis Y-Y and belonging to the cylindrical wall 8 of the lead-holder 7. During this relative sliding, the threaded portions 17 of the flexible tabs 16 slide on the threading of the threaded body 12 with a slight interference that in any case does not hinder sliding due to the elastic radial deformability of said tabs 16.

Subsequently, the threaded body 12 together with the driving element 13 are mounted in the holding body 4 by inserting the tubular body 8 through the second opening 4*b*, seat 9 facing the first opening 4*a*.

Due to the conical shape of the inner surface of the holding body 4, when tabs 16 come close to the given axial portion C of the holding body 4, they enter into contact with the inner surface which radially forces them towards the threaded body 12, thus ensuring mutual engagement of the threads.

Ribs 5 enter the axial cuts 11 of the tubular body 8 so as to prevent mutual rotation between the lead-holder 7 and holding body 4.

The insertion takes place until bringing an annular surface 23 (FIGS. 2 and 5) transverse to axis Z-Z and belonging to the operating portion 14, in abutment against the edge of the second opening 4*b*.

The second annular ridges 19 step over the first annular ridges 6 with a snap-engagement, until the annular ridges of one of the two elements is brought in register with the annular recesses of the other, and they axially lock the driving element 13 in the holding body 4. The driving element 13 is at all events free to rotate in the holding body 4 around the longitudinal axis X-X.

Seal 21 remains interposed between the inner surface of the holding body 4 and the annular seat 20 of the driving element 13.

In the mounted configuration, tabs 16 are maintained in contact with the threaded body 12 by the inner wall of the holding body 4 so that mutual engagement of the threads is ensured. As a result, by rotating the operating portion 14, the lead nut-worm screw coupling between the lead-holder 7 and the driving element 13 causes translation along axis X-X of the lead-holder 7 and the lead 3 installed thereon.

Lead 3 is preferably mounted when assembly of container 2 has been completed, and it is inserted from the first opening 4*a* and locked in seat 9 through the interference with the axial ridges 10 and also taking advantage of the radial elasticity of the three arched walls of the cylindrical wall 8.

The elements are such sized that seat 9 for lead 3 can be brought as far as the first opening 4*a*, so that lead 3 can be drawn out even when it is very short.

In accordance with an alternative embodiment not shown, the externally threaded rod is integral with the operating portion 14 and therefore is part of the driving element 13, while the flexible tabs 16 are disposed on a tubular body integral with seat 9 and are therefore part of the lead-holder 7. The operating principle does not change.

Figure 2:
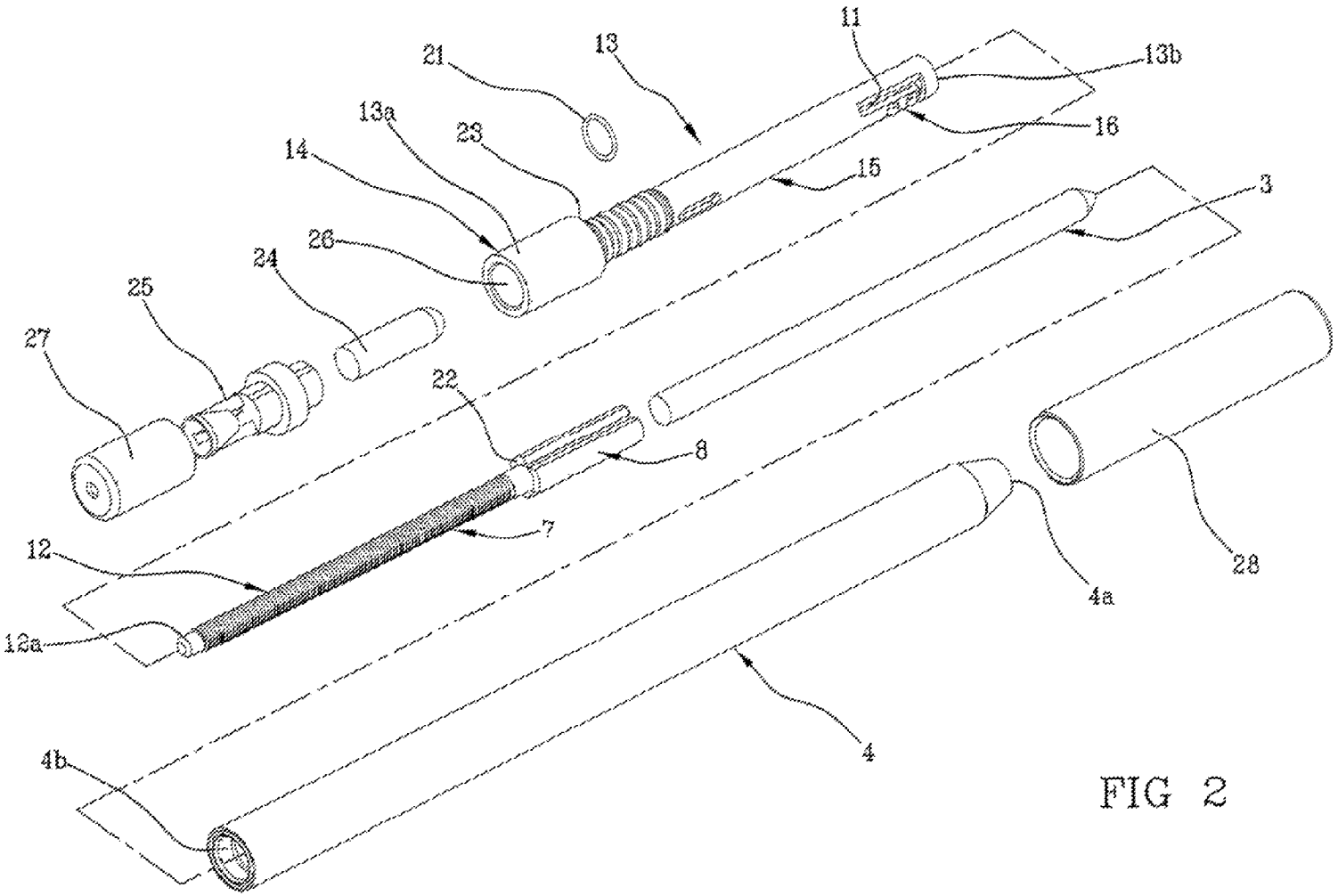
FIG. 2 is an exploded perspective view of the pencil seen in FIG. 1.

Container 2 can also be provided with accessories. For instance, as shown in FIGS. 1 and 2, a small sponge 24 and a pencil sharpener suitable for sharpening the lead 3 alone are inserted in a housing 26 formed in the operating portion 14. The pencil sharpener 25 is protected by a cap 27.

In the embodiments in which the small sponge and pencil sharpener are not present, housing 26 is closed by a suitable plug, not shown.

Preferably, irrespective of the specific embodiment, container 2 comprises a cap 28 disposed on the first end of the holding body 4 for protection of the lead tip or, if the lead tip is fully retracted, for preventing dust or other substances from penetrating through the first opening 4*a*.

The present invention reaches the intended purposes and achieves important advantages.

First of all, the present invention allows the container to be easily and quickly assembled, because all couplings are obtained through relative linear movements between the components and by snap-fit or friction-fit. In addition, all components of the container are inserted from one end alone of the holding body. Therefore, the assembly times can be reduced and use of less complicated machines and/or less qualified manpower can be provided and, as a result, the assembly costs are reduced.

Mounting of the lead is simple too, because the lead-holder made up of arched walls provided with axial ridges enables the lead to be locked by a mere axial movement.

The present invention possibly allows the final user to disassemble the container for internally cleaning it before replacing the lead with a new one.

The cap can be removed and put back while the lead tip lies within the holding body and therefore cannot be damaged.

In addition, the seal together with the cap make the user sure that the volatile substances of the cosmetic material are not dispersed and help in maintaining the cosmetic quality over time.

The axial ribs not only prevent the lead-holder from rotating, but also avoid the lead tossing about in the container so that it cannot be damaged during handling or transport, when carried in a handbag for example.

What is claimed is:

1. A container for propelling cosmetic pencils, comprising:

a tubular holding body (4) having a first opening (4*a*) and a second opening (4*b*) opposite to the first one (4*a*) and presenting an inner surface;

a lead-holder (7) axially movable in the holding body (4) and having a seat (9) facing the first opening (4*a*) and designed to receive a lead (3) of cosmetic material;

a driving element (13) movable in rotation in the holding body (4) and having an operating portion (14) protruding from the second opening (4*b*);

means for converting the rotation motion of the operating portion (14) into the axial motion of the lead-holder (7);

wherein said converting means comprises a threaded body (12) being part of the lead-holder (7), and tabs (16) that are radially flexible in an elastic manner and integral with the driving element (13) and having threaded portions (17) in engagement with the threaded body (12);

characterized in that the inner surface of the holding body (4) has an axial portion (C) of reduced inner diameter placed close to the tabs (16) to keep the threaded portions (17) of said tabs (16) against said threaded body (12) and ensure mutual engagement of the threads; said axial portion (C) having a conical shape diverging towards the second opening (4*b*).

2. A container as claimed in claim 1, wherein the driving element (13) is of tubular shape, and the threaded body (12) is an externally threaded rod and inserted in the driving element (13).

3. A container as claimed in claim 1, comprising axial ribs (5) internal to the holding body (4) and engaged in grooves (11) formed in the lead-holder (7) to prevent rotation of the lead-holder (7) in the holding body (4).

4. A container as claimed in claim 3, wherein the axial ribs (5) substantially extend as far as the first opening (4*a*) to axially guide the lead (3) and prevent radial displacements of same.

5. A container as claimed in claim 4, wherein the seat (9) for the lead (3) is delimited by a cylindrical wall (8); the grooves (11) being axial cuts formed in said cylindrical wall (8) and the axial ribs (5) being inserted in said axial cuts (11) and facing the inside of the seat (9).

6. A container as claimed in claim 1, comprising snap-engagement means interposed between the driving element (13) and the holding body (4) and positioned close to the second opening (4*b*), to axially lock said driving element (13) relative to said holding body (4).

7. A container as claimed in claim 6, wherein the snap-engagement means comprises first annular ridges (6) disposed on an inner surface of the holding body (4) and second annular ridges (19) disposed on an outer surface of the driving element (13).

8. A container as claimed in claim 1, comprising an annular seal (21) interposed between the driving element (13) and the holding body (4) and positioned at the second end (4*b*).

9. A propelling cosmetic pencil comprising a container (2) as claimed in claim 1 and a lead (3) of cosmetic material mounted in the lead-holder (7).

10. A process for assembling a container for propelling cosmetic pencils comprising the following steps:

i) providing a holding body (4) having a first opening (4*a*) and a second opening (4*b*) opposite to the first one (4*a*) and presenting an inner surface;

ii) providing a lead-holder (7) having a seat (9) designed to receive a lead (3) of cosmetic material;

iii) providing a driving element (13) having an operating portion (14);

iv) causing axial sliding of a threaded body (12) integral with the lead-holder (7) or the driving element (13), on threaded portions (17) of radially flexible tabs (16) integral with the driving element (13) or the lead-holder (7);

v) axially inserting the driving element (13) and the lead-holder (7) through the second opening (4*b*) of the holding body (4), the seat (9) of the lead-holder (7) facing the first opening (4*a*) and the operating portion (14) of the driving element (13) being maintained in a position protruding from the second opening (4*b*);

v') bringing said tabs (16) close to an axial portion (C) of the inner surface of the holding body (4) having a reduced inner diameter, where the tabs (16) enter into contact with the inner surface which radially forces said tabs (16) towards the threaded body (12), thus ensuring mutual engagement of the threads; said axial portion (C) having a conical shape diverging towards the second opening (4*b*);

vi) locking rotation of the lead-holder (7) in the holding body (4);

vii) axially locking the driving element (13) on the holding body (4).

11. A process as claimed in claim 10, wherein step vi) is carried out through engagement, by axial movement, of axial ribs (5) internal to the holding body (4) in axial grooves (11) formed in the lead-holder (7).

12. A process as claimed in claim 10, wherein step vii) is carried out through snap-engagement, by axial movement, of first annular ridges (6) internal to the holding body (4) with second annular ridges (19) of the driving element (13).

* * * * *

UNITED STATES PATENT AND TRADEMARK OFFICE

CERTIFICATE OF CORRECTION

PATENT NO. : 8,534,946 B2
APPLICATION NO. : 12/766989
DATED : September 17, 2013
INVENTOR(S) : Franco Cont It is certified that error appears in the above-identified patent and that said Letters Patent is hereby corrected as shown below:

On the Title Page of the patent, at Item (73), in the name of the Assignee, please delete "F.I.LA. Fabrica" and insert therefor -- F.I.L.A. - Fabbrica --.

Signed and Sealed this
Twelfth Day of November, 2013

Teresa Stanek Rea
*Deputy Director of the United States Patent and Trademark Office*